United States Patent [19]

Schenk

[11] 4,085,937

[45] Apr. 25, 1978

[54] COMPOSITION FOR A FLOATER GOLF BALL AND THE FLOATER GOLF BALL MADE THEREFROM

[75] Inventor: Bernard H. Schenk, Crown Point, Ind.

[73] Assignee: Hugh J. McLaughlin & Son, Inc., Crown Point, Ind.

[21] Appl. No.: 617,267

[22] Filed: Sep. 26, 1975

[51] Int. Cl.[2] ..... A63B 37/00; C08J 9/32; C08K 7/14

[52] U.S. Cl. ..... 273/218; 273/219; 273/220; 273/230; 273/235 A; 273/235 R; 260/2.5 R; 260/2.5 B; 260/2.5 H; 260/998.14

[58] Field of Search ..... 260/998.14, 2.5 B, 2.5 R, 260/2.5 H; 273/218, 219, 235 R, 235 A, 220, 221, 230

[56] References Cited

U.S. PATENT DOCUMENTS

| | | | |
|---|---|---|---|
| 736,230 | 8/1903 | Davis | 273/219 |
| 3,238,156 | 3/1966 | Kohrn | 260/2.5 B |
| 3,373,123 | 3/1968 | Brice | 260/2.5 B |
| 3,438,933 | 4/1969 | Bartsch | 260/998.14 |
| 3,454,280 | 7/1969 | Harrison et al. | 273/235 R |
| 3,478,132 | 11/1969 | Randolph | 260/998.14 |
| 3,671,477 | 6/1972 | Nesbitt | 260/998.14 |
| 3,756,607 | 9/1973 | Lukinac et al. | 273/218 |
| 3,804,421 | 4/1974 | Alex et al. | 273/218 |
| 3,819,768 | 6/1974 | Molitor | 273/235 R |
| 3,883,145 | 5/1975 | Cox et al. | 260/998.14 |
| 3,974,238 | 8/1976 | Schweiker et al. | 260/998.14 |

*Primary Examiner*—Allan Lieberman
*Attorney, Agent, or Firm*—Harry P. Eichin

[57] ABSTRACT

A floater golf ball of molded construction, having a specific gravity of less than about 0.98 is made to conform to the regulations of the United States Golf Association, by a method of compounding a polymeric composition comprising a mixture of elastomers, monomer, polymerization initiator, reinforcing filler materials and flotation materials, said mixture having dispersed therein, a predetermined amount of the flotation material comprising microscopic hollow glass spheres of from about 5% to about 10% by weight of the mixture, and molding and polymerizing said mixture into a golf ball sphere under pressure.

8 Claims, 4 Drawing Figures

COMPOSITION FOR A FLOATER GOLF BALL AND THE FLOATER GOLF BALL MADE THEREFROM

This invention relates to a novel floater golf ball of molded construction. This invention more particularly relates to a polymeric composition for a spherical construction of a two-piece molded floater golf ball or a solid molded floater golf ball, which has a specific gravity of less than 0.98, which provides the desired characteristics of good visibility in floating, and which has the compression, hardness, rebound and click required by golfers for golf balls.

The United States Golf Association (U S G A) has three regulations for golf balls used in official play. They can be made of any material and in any manner, but they must, (1) weigh less than 1.62 ounces (45.93 gms.), (2) be greater than 1.68 inches (42.67 mm.) in diameter, and (3) not exceed a velocity of 250 feet (76.2 m.) per second (with a 2% tolerance) for a ball driven on the U S G A testing machine. Thus, resiliency of an approved ball is limited by the U S G A velocity test.

In addition to these required characteristics, other desirable features of a high quality official golf ball are good compression, good cut, and shatter resistance. Another important quality for a good golf ball is having an elastic modulus providing the capability for storing the energy of deformation and quickly releasing it to regain sphericity after being sharply struck by a golf club. It is also important that when a quality golf ball is made by a combination of a pressure molded cover and core, or when it is of solid molded construction, it should provide a good click sound when fairly hit, and should have inherently good balance to thereby provide aerodynamic stability and true roll on a putting surface.

Among the several hazards commonly incorporated in the terrain of a golf course and specifically created and designed to challenge the skill of the players are occasional bodies of water transversely or laterally disposed along the general direction of play from tee to green. When confronted with such a water hazard during the course of play, some golfers prefer to use a ball that will float in water. They thereby gain mental confidence in coordinating the stroking of the ball, which serves psychologically to overcome the hazard. In case the ball, by misdirection, does drop into the water hazard, the floater type of golf ball affords the possibility for retrieval.

A large number of floater golf balls are also sold for use on aqua practice ranges. Aqua golf ranges are becoming increasingly popular because of their frugal use of land and their economy of operation. A golfer hits the floater golf balls off a tee into a body of water. The floating range balls are retrieved for reuse by a simple skimming means or by circulating the water in a predetermined pattern to a collection point where they are gathered onto a screen.

U S G A regulation size golf balls float in water if they weigh about 39.0 grams, but at that weight they do not float with enough of the ball above the water surface to provide good visibility, particularly if the body of water has ripples or waves. Desirable flotation for good visibility and ready retrieval of a floater golf ball is provided for most conditions when more than about one-fourth of the diametral cross sectional area of the ball floats above the surface of still water. For such good visibility flotation, floater golf balls should weigh less than about 39.0 gms., such as from 37 to about 38.5 gms.

Heretofore the customary mode of manufacturing a golf ball light enough to float in water, was to wind rubber thread around a nearly pure gum rubber core, and then to envelop this fabrication with a thin cover of balata rubber or other polymeric cover material. The wound core method of constructing a golf ball is fairly expensive and the density of the finished article is controlled by varying the tension in the rubber thread as it is wound on the golf ball core. Floater balls made by this method show a rather low compression when tested on the standard golf ball compression tester and tend to go out of round when the ball is hit hard, as the thread windings shift from distortion of the relatively soft core. Thus the wound floater ball does not fully meet the desired characteristics of durability and resilience to store the energy of the large impact forces of the golf club head and quickly return the ball to its original spherical shape.

With minimal resilience and the tendency of the thread windings to shift, the wound floater ball does not readily regain the true spherical shape desired for optimum aerodynamic flight and true rolling on a putting green surface.

Attempts to make a floater golf ball of two piece or solid construction have generally employed an elastomer with reinforcing and filler materials. Filler materials to provide the lighter density required for good visibility flotation have been tried, such as finely divided cork, plastic fiber, cellulose flock, plastic flour and the like. Such materials need to be uniformly mixed and distributed throughout the viscous elastomeric mass to provide the lighter density required for flotation. When apparently lighter materials are compounded into an appropriate elastomer and compression molded, it is found that the compound is heavier rather than lighter, and thus does not float in water. While not completely understood, it is believed that during the steps of intermixing the lighter materials into the viscous elastomeric compound and of compacting the resulting mix in the pressure molding and curing steps of making the ball, the air pockets and interstices usually present in such lighter materials are broken up or filled in with the other constituents of the compound and are further compacted in the molding step. Thus the apparently lighter materials are made more dense in the finished article. Balls made with such compactible materials have not been uniformly good floater golf balls and have not had the lighter density necessary for good visibility flotation.

Attempts were also made to mold a floater golf ball having a core of solid polyethylene since it has a density of about 0.9 and does float in water. However, such balls were found unsatisfactory in play because the ball was too hard and was dead when hit. The ball additionally did not have the requisite characteristic of storing the energy of deformation and quickly restoring the ball to sphericity. Also, the polyethylene ball proved rather costly to make.

Other attempts were made to achieve lighter density for flotation by incorporating foaming materials into the core mixture, but it was found to be difficult to obtain a uniform structure. Such molded cores were also found to be too mushy or soft, and not durable in play.

Unitary molded golf ball compositions and cover compositions and constructions have been known in the art, such as disclosed in U.S. Pat. Nos. 3,313,545 to Bartsch and 3,395,109 to Molitor et al. These patents do not comprehend the problems not teach a composition or method for making a floater gold ball with good flotation visibility.

It is an object of this invention to provide a composition for making a floater gold ball of two-piece or of solid construction which has the requisite physical properties and density to provide good flotation visibility in water.

It is another object of this invention to provide a composition for a floater golf ball which has the regulation U S G A properties and other desirable properties of good click, good velocity and a high capacity for storing deformation energy and quick return to sphericity.

It is another object of this invention to provide a composition for a solid floater golf ball which has the requisite physical properties and density to provide good flotation visibility in water.

It is another object of this invention to provide a composition and method of incorporating reinforcing and low density material into the composition to yield a molded ball of controlled density.

This then being the state of the art it was discovered that small hollow glass spheres or bubbles could be used in a carefully controlled method of intermixing them with an elastomer and other reinforcing and filler materials to produce a golf ball core for two-piece or solid construction having desirable characteristics and having a density to provide good visibility flotation. Good visibility flotation is provided when at least 28% of the cross sectional area of the ball floats above the surface of still water. The glass bubbles found to be particularly useful as flotation material in floater golf ball compounding are hollow spheres of glass having chemical properties resembling those of window glass, wherein at least 90% by bolume of the spheres have a diameter of from about 20 to about 95 microns and have a ratio of wall thickness to diameter of about 1.5% to about 3.0%. Such glass microspheres were found to have a low density such as 0.2 to 0.4 grams per cc. and, being substantially spherical in configuration, to have a very high crush strength which is sufficient to resist the stresses imposed in compounding and pressure molding the microspheres into a polymerized elastomeric compound. Mixtures of from about 5 to about 10 percent by weight of glass microspheres in an elastomeric composition, were formulated and molded into a floater golf ball having good flotation visibility.

The article and method of making the floater golf ball of the present invention will become apparent from the following description when considered together with the accompanying drawing which is set forth as being exemplary of the embodiments of the present invention, and which is not intended to be limitative thereof, and wherein.

Figure 1:
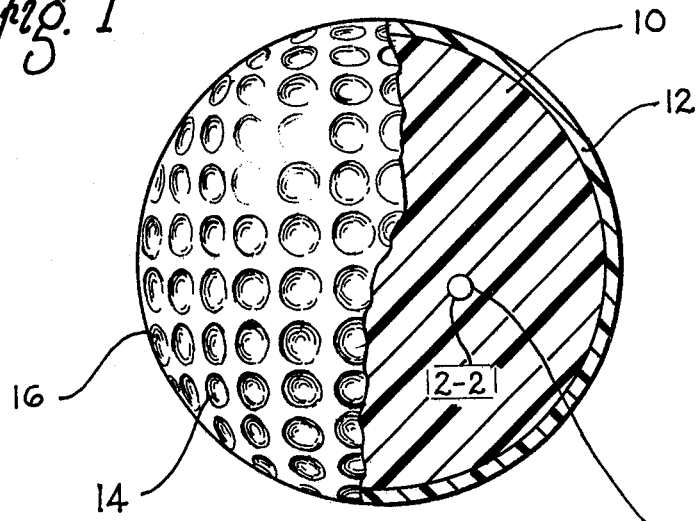
FIG. 1 is a perspective view partly in section of a floater golf ball of two piece construction suitable for official play under U S G A regulations made in accordance with the invention.

With reference to the drawing, FIG. 1 shows a floater golf ball of two piece construction made with a core 10 molded of the polymeric composition of the invention, having a molded thin tough ionomer cover 12 which is formed with conventionally shaped dimples 14 and finished with multiple coats of a durable enamel 16. Typically, the enameled gold ball is hot stamped with indicia to designate desired identification, and is then coated with a clear enamel to protect the identifying marks. A typical cover 12 can be premolded in two hollow hemispheres having about a 0.068 inch (1.7 mm.) wall thickness, made of balata rubber or Surlyn ionomer stock, molded together about the core 10.

Figure 2:
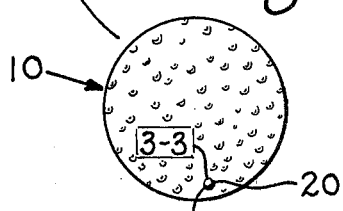
FIG. 2 is an enlarged sectional view of the golf ball area of FIG. 1 identified as 2—2 in FIG. 1.
Figure 3:
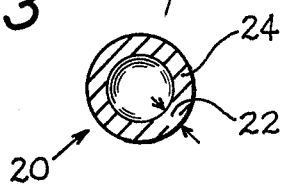
FIG. 3 is a greatly enlarged vertical sectional view of one of the spherical bubbles of the golf ball area of FIG. 2 identified as 3—3 in FIG. 2.
Figure 4:
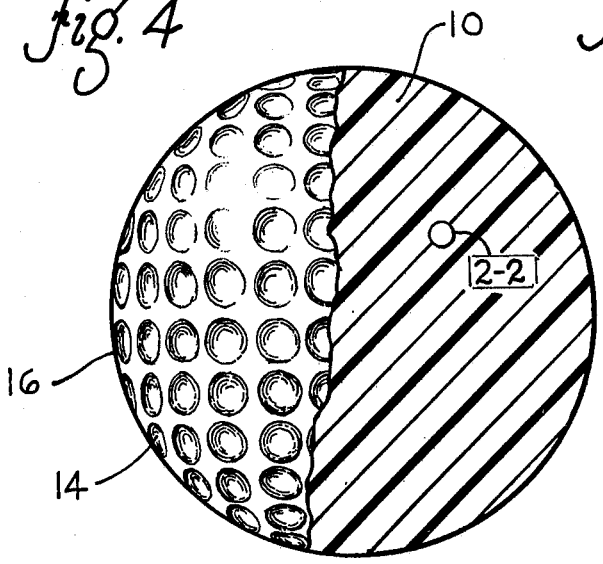
FIG. 4 is a perspective view partly in section of a floater golf ball of solid construction suitable for official play under U S G A regulations made in accordance with the invention.

FIG. 4 shows a floater golf ball of an alternate solid construction made of a core 10 molded of the polymeric composition of the invention, the outer surface of this core being formed with conventionally shaped dimples and finished with multiple coats of a durable enamel 16 and identifying marks as described above. A typical area 2—2 of the cross-sectional portions of FIGS. 1 and 4 is shown greatly enlarged in FIG. 2 wherein there is shown a hollow microsphere 20 typical of the glass bubbles 20 dispersed throughout the molded polymeric core 10. In FIG. 3 is shown a further enlarged cross sectional view of a typical glass bubble 20 distributed throughout the polymeric coposition of the invention. The hollow glass microspheres used as flotation material in the comosition of the invention are selected from commercial material having a relatively heavy wall with high crush strength, wherein 90% by volume of the bubbles range in outside diameter from 20 to 95 microns.

Wall thickness 22 (FIG. 3) of the bubbles used in the composition range in size from about 0.5 to about 2.0 microns depending on the size of the individual glass microsphere. The surfaces 24 of the spheres are free of treatment, and in general the chemical properties of the inorganic glass bubbles resemble those of window glass.

The average diameter of the microspheres is about 50 microns and they have a ratio of wall thickness to diameter of about 1.5% to about 3.0% which provides a bubble density of about 0.2 to 0.4 grams/cc. Such bubbles have been found to have a high crush strength and hydrostatic tests show a test pressure of 2200 psi for 10% collapse. Substantially higher pressures are tolerated in viscous media when shear stresses are avoided.

These qualities were found to be particularly useful when the preselected grade of inorganic glass microspheres was carefully compounded as the flotation material, into the composition of the invention for making floater golf balls of predetermined density.

Compositions are well known in the art for molding a wide variety of elastomeric constructions having characteristics similar to non-floating golf balls. Resilient elastomeric items such as shock absorbers, O-rings, rubber soling and heels, solid and hollow molded goods have, for many years, been compounded in a system commonly identified as peroxide-coagent vulcanization. The term coagent is meant to encompass a variety of compounds but in the instant invention it relates more specifically to polyfunctional monomers as they are used in the cross-linking of elastomers with peroxides. U.S. Pat. No. 3,261,888 to Cornell et al., relates to such a peroxide-polyfunctional cure system.

For economic reasons an elastomeric formulation used in the manufacturing of golf balls should be inexpensive and therefore the amount of the monomer ingredient which is expensive, should be kept to a minimum to provide the lowest cost per volume. The precise characteristics required to meet regulation golf ball standards and have a predetermined density to provide good flotation visibility, requires an elastomeric core composition intermixed with reinforcing filler material and with durable flotation material dispersed throughout. Floater golf ball products according to this invention have been manufactured from a formulation consisting of the following:

| Constituent | Preferred parts by wgt. | Range parts by wgt. |
|---|---|---|
| Elastomer | 100 | |
| Methylacrylate monomer | 30 | 25–35 |
| Precipitated Silica | 26.8 | 23–31 |
| Powdered Polyethylene | 5.5 | 4–15 |
| Dicumyl peroxide mix | 5.0 | 4–6.8 |
| Magnesium oxide | 3.3 | 2.0–4.5 |
| Glass microspheres | 13.1 | 10–18 |

In the above floater formulation, the elastomer constituent is comprised of unsaturated polymers such as a premix of cis 1,4 polybutadiene and cis 1,4 polyisoprene to be intimately intermixed with the monomer.

For the compound of the invention, it is preferred to use a system employing polyfunctional monomer as coagent in a peroxide vulcanization. Trimethacrylates have been principally used in prior art golf ball compositions but dimethacrylates may be used, or a mixture of trimethacrylates and dimethacrylates may be used. The floater ball formulation of the invention preferably uses a premix of dimethacrylate and trimethacrylate monomers. The amount of monomer in the composition can be from about 25 to about 35 parts by weight of the elastomer, but amounts between about 28 to about 32 parts by weight are preferred.

Filler material such as the precipitated silica and the powdered polyethylene constituents of the above formulation are used to control the bulk of the mixture and to reinforce the molded golf ball structure. The ultra high molecular weight polyethylene powder has proven to have a high capacity for energy absorption and substantially improves the shatter resistance of floater golf balls. The amount of the filler materials in the composition of the invention can be from about 28 to about 38 parts by weight of the elastomer, but amounts between about 30 to 37 parts by weight are preferred. The magnesium oxide constituent is used to control the pH of the composition.

The dicumyl peroxide mix is used as a polymerization initiator effective with the polyfunctional monomers to initiate polymerization and vulcanization of the compound. A mix of 40% strength of dicumyl peroxide on calcium carbonate or KE clay in an amount of from about 4 to 6.8 parts by weight of the elastomer is preferred for the composition.

Flotation material is provided in the inorganic microspheres described above. The glass microspheres are preselected for crush resistance and for optimum control of a predetermined density golf ball, comprising a class of hollow glass bubbles wherein at least 90% by volume of the microspheres range in outside diameter from about 20 to 95 microns and have a wall thickness to diameter ratio of from about 1.5 to 3.0%. For the composition of the invention, an amount of from about 10 to 18 parts by weight of the elastomer and from about 5 to 10% by weight of the entire composition, of the above grade of microspheres is used, but amounts between about 12 to 17 parts by weight of the elastomer are preferred to make a good visibility floater golf ball.

For the production of floater golf balls, the constituents of the above formulation are weighed, and may be initially mixed in a preferred order in an internal mixer such as a Banbury mixer. The elastomers are first mixed together and the filler materials such as the silica and powdered polyethylene are then added along with the magnesium oxide. The monomer is then added and mixing is continued to disperse the ingredients uniformly throughout the batch in a manner well known in the rubber comounding art. After the foregoing ingredients have been thoroughly intermingled, the peroxide constituent is added and mixing continues for about an additional minute. The batch is then transferred to a rubber mill to incorporate the glass bubble constituent into the batch and to sheet the mix. All of the foregoing mixing of the ingredients can be done on a rubber mill as is well known in the art.

The rolls of the rubber mill are set in a non-tight condition, to avoid crushing the glass microspheres of the flotation material, when that material is uniformly distributed into the mix being worked on the mill. The temperature of the mixing and sheeting operations is not critical, but should be kept below curing temperature, following conventional rubber compounding practice. The sheeted mixed composition is then rolled into a coil, is deaerated, and is then extruded by a conventional controlled volume portioning apparatus into preform slugs suitable for molding into floater golf ball cores or into solid floater golf balls.

When making a two piece floater golf ball, the appropriate volume of preform slug of the composition of the invention is compression molded into a spherical core of about 1.51 inch (38.35 mm.) diameter. The mating halves of the mold are pressurized and heated to a temperature of about 320° F. for about 14 minutes to cure the core throughout. The floater core is then encapsulated in a cover by applying preformed halves of a vulcanizable cover material such as Balata rubber, or a thermoplastic cover material such as Surlyn ionomer, about the core, and precision molding the covered core in golf ball dies having means providing the dimpled surface to the resulting ball. Thermoplastic cover material can also be injection molded about the floater core in a manner well known in the art. Parting line flash is removed and multiple coats of durable enamel are applied to yield a two-piece floater golf ball 1.685 inch (42.80 mm.) in diameter having a weight of about from 37 to 38.5 grams.

When making a solid floater golf ball, a volume of preform slug of the composition of the invention appropriate for the solid construction is compression molded into a spherical ball about 1.685 inch (42.80 mm.) in diameter in a manner similar to that described above for a two piece ball. The precision dies used for providing the dimpled surface to the solid ball are slightly larger in diameter than the dies for a two piece ball to compensate for greater shrinkage of the solid ball mass. Parting line flash is removed and multiple coats of durable enamel are applied to yield a solid floater golf ball of 1.685 inch (42.80 mm.) diameter having a weight of from 37 to 38.5 grams.

It is to be understood that other modifications and changes to the preferred embodiments of the invention herein shown and described can also be made by a person skilled in the art without departing from the spirit and scope of the invention.

What is claimed is:

1. A polymeric composition suitable for molding floater golf balls comprising a peroxide-coagent vulcanizate having dispersed therein from about 5% to about 10% by weight of the composition of hollow glass microspheres wherein at least 90% by volume of said microspheres have a size of from about 20 to about 95 microns, have a density in the range of from about 0.2 to about 0.4 grams/cc., and have a ratio of wall thickness to diameter in the range of from about 1.5% to about 3.0%, wherein said polymeric composition has a specific gravity of less than 0.98.

2. The composition of claim 1 wherein at least 90% by volume of said microspheres have a size of from about 20 to about 90 microns and a wall thickness of from about 0.5 to about 2.0 microns.

3. The composition of claim 2 containing from about 15% to about 25% by weight of filler material.

4. A floater golf ball having a weight of less than about 39 grams and comprising a preformed solid core, said core being compounded of a peroxide-coagent vulcanizate intermixed with a flotation material comprising from about 5% to about 10% by weight of hollow glass microspheres dispersed throughout said core, wherein at least 90% by volume of said microspheres have a size of from about 20 to about 95 microns, said microspheres have a density in the range of from about 0.2 to about 0.4 grams/cc., and said microspheres have a ratio of wall thickness to diameter in the range of from about 1.5% to about 3.0%.

5. The floater golf ball of claim 4 wherein at least 90% by volume of the glass microspheres are from about 20 to about 90 microns in diameter and have a wall thickness of from about 0.5 to about 2.0 microns.

6. The floater golf ball of claim 4 wherein said core is compounded of from about 68% to about 74% by weight of polymerized constituents intermixed with from about 15% to about 25% by weight of filler material.

7. The floater golf ball of claim 4 wherein said core has its outer surface coated with enamel.

8. The floater golf ball of claim 4 wherein said core is encased in a molded polymeric cover.

* * * * *